United States Patent [19]

Payne

[11] 4,358,250

[45] Nov. 9, 1982

[54] APPARATUS FOR HARNESSING AND STORAGE OF WIND ENERGY

[76] Inventor: Barrett M. M. Payne, 21 Portland Dr., Umhlanga Rocks, South Africa, 4320

[21] Appl. No.: 156,269

[22] Filed: Jun. 3, 1980

[30] Foreign Application Priority Data

Jun. 8, 1979 [ZA] South Africa ..... 79/2834

[51] Int. Cl.[3] ..... F04B 49/08; F04B 7/02

[52] U.S. Cl. ..... 417/302; 417/334; 60/398

[58] Field of Search ..... 417/334, 302, 540; 60/398, 413, 415

[56] References Cited

U.S. PATENT DOCUMENTS

| | | | |
|---|---|---|---|
| 2,454,058 | 11/1948 | Hays | 60/398 |
| 3,593,824 | 7/1971 | Gregory | 60/413 X |
| 4,036,106 | 7/1977 | Athy | 91/5 |
| 4,174,926 | 11/1979 | Hamrick et al. | 417/334 |
| 4,215,545 | 8/1980 | Morello | 60/413 |

*Primary Examiner*—Richard E. Gluck

*Attorney, Agent, or Firm*—Morgan, Finnegan, Pine, Foley & Lee

[57] ABSTRACT

A prime mover is provided particularly a wind energized prime mover (10) comprising a compressor (20) driven by a wind wheel (22) and arranged simultaneously to charge with compressed air, a first, small capacity reservoir (24) and a second, large capacity reservoir (26), the first reservoir (24) being connected to a compressed air demand and being rapidly charged and depleted in light winds when the compressor (20) is delivering just sufficient air to satisfy the demand and the second reservoir (26) being charged when the compressor (20) is delivering more air than is required, the requirement of the demand being determined by a pressure reducing valve 28 and the nature of the work done, the second reservoir (26) being connected to the demand line (35) across a pressure reducing valve (32) whereby the compressed air therein will be released to the demand when the pressure in the demand line (35) drops below a predetermined minimum. The compressed air demand shown is a pumping arrangement with a pneumatic ram, comprising a cylinder (16) and a piston (14), which is connected to the pull rod (15) of a borehole piston.

1 Claim, 8 Drawing Figures

APPARATUS FOR HARNESSING AND STORAGE OF WIND ENERGY

BACKGROUND OF THE INVENTION

This invention relates to wind engines and in particular to a wind driven pumping apparatus, but it will be appreciated that the application of the engine need not be restricted to pumping water from boreholes which is the application described in the specification.

The invention is intended to exploit the fact that, because gas is compressible the energy therein can be stored and released in a controlled manner. This is of particular significance for wind-energised apparatus since, as is commonly known, there is a considerable and continuous variation in the strength at which the wind blows. Conventional windmills do not utilise fully the upper and lower scales of wind speeds, they suffer from the defect that furling and braking means must be provided for the windmill to stop due to risk of damage thereto, when the wind blows too hard. At low wind speeds the windmill does not work efficiently owing to the often large starting resistance applied to the wind wheel by gear trains and the mass of the water required to be lifted from the well.

It is an object of this invention to provide a windmill that is capable of overcoming this problem.

SUMMARY OF THE INVENTION

According to the invention a prime mover is provided comprising a compressor and energising means therefor, a first reservoir for the compressed gas delivered by compressor, regulator means arranged to control the release of the gas from the reservoir to a compressed gas demand, a second reservoir adapted to receive compressed gas from the compressor and arranged to deliver the compressed gas stored therein selectively to the compressed gas demand through the regulator means, valve means being provided to prevent the movement of the gas from the second reservoir to the first reservoir and the valve and regulator means being arranged to direct the compressed gas to the second reservoir when the compressor is delivering more than a predetermined amount of compressed gas and to direct the compressed gas stored in the second reservoir to the compressed gas demand when the compressor is delivering less than the predetermined amount of compressed gas.

It is therefore and important aspect of the invention that the compressor should be such as to be easily driven by the prime mover to which it is coupled. This would usually imply a compressor having a relatively small output for each working cycle though it might conveniently operate at a very high compression ratio.

The reservoir and the regulator means provides a system in which the compressor can be driven in substantially the lightest or heaviest winds.

The second reservoir may be constituted by at least a tubular support column for a wind driven energising means for the compressor and the first reservoir being constituted by at least a conduit connecting the compressor with the compressed gas demand.

BRIEF DESCRIPTION OF THE DRAWINGS

An embodiment of the invention is described with reference to the accompanying drawings in which.

DETAILED DESCRIPTION OF THE PREFERRED EMBODIMENT

Figure 1:
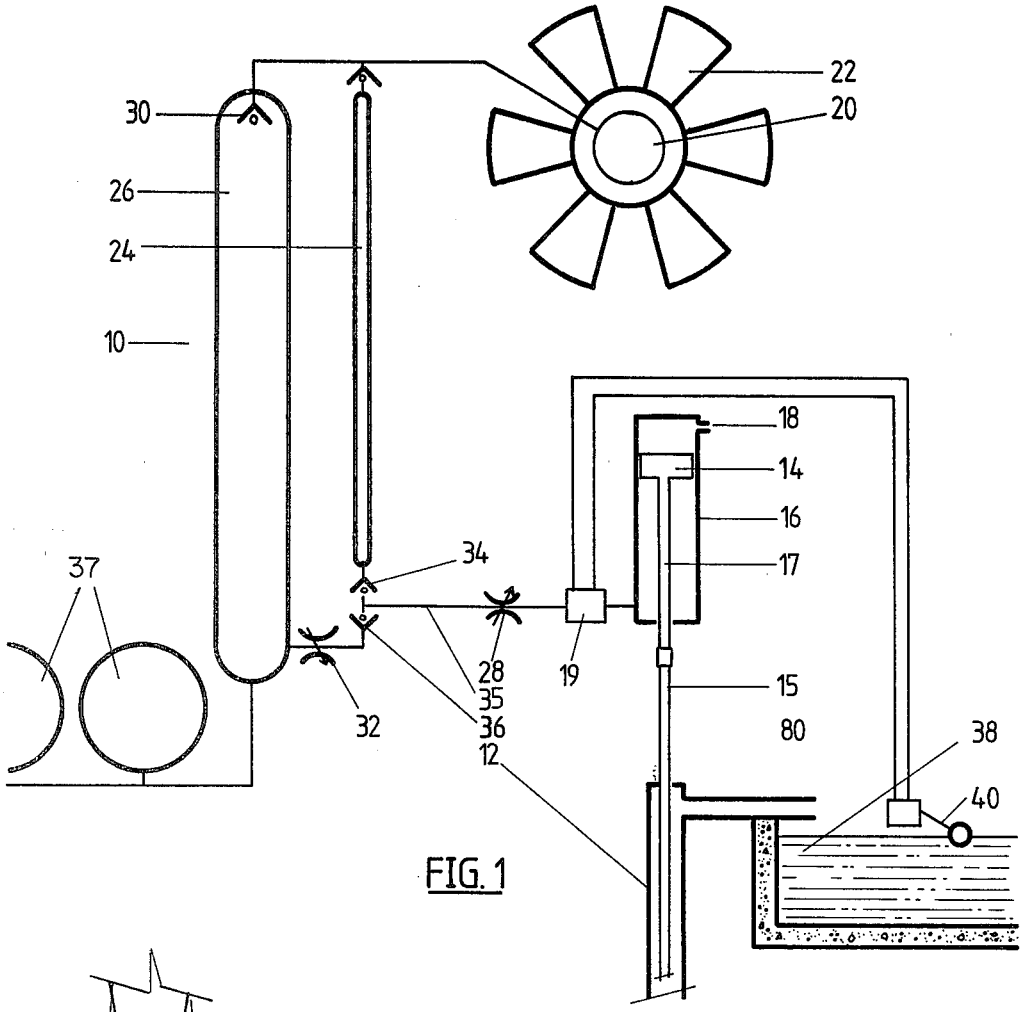
FIG. 1 is a circuit diagram of the prime mover in an application as a windmill.

The wind engine of the invention is shown in FIG. 1 in an application as a windmill 10 which is arranged to pump water from a borehole 12 by means of a single acting pneumatic piston 14 mounted directly onto the shaft 15 of a standard borehole pump.

The piston 14 is located in a cylinder 16 the top of which is open to atmosphere through a vent 18 while a directional control valve 19, such as a spool valve actuated by a well known system of sensors tripped by triggers on the shaft, routes compressed air into the cylinder 16 below the piston 14 to power the piston 14 during the upstroke. The directional control valve 19 allows the air to exhaust for the down-stroke of the piston 14. The compressed air is supplied by a wind powered compressor 20 via a conduit 24 which corresponds to the first reservoir mentioned above. A second reservoir is provided which is constituted by the tubular support tower 26 of the wind wheel 22 connected to the compressor 20.

The piston 14 has a short stroke and is adapted to work at low loads. In tests carried out with the windmill it was found that a lift of 168 kg was obtained with an operating pressure of 2.1 kg. $cm^{-2}$ and a cylinder with an internal diameter of 100 mm. To increase the lift it is necessary merely to increase the diameter of the cylinder, a cylinder with an internal diameter of 250 mm for instance, increasing the lift to 1080 kg. The low work load enables the windmill 10 to operate at low wind speeds. In addition, the conduit 24 connects directly with the work load and, as it has a low volume, the air stored therein is rapidly depleted. Conversely, when there is excess available wind it is quickly charged up. Thus there is very little of the braking effect on the wheel 22 which is associated with conventional windmills, because there is an absolute minimum of force against the compressor 20. It is the applicant's experience that the present windmill starts turning at 5 $km.h^{-1}$ whereas conventional windmills only start at 12 $km.h^{-1}$.

This is a considerable improvement if it is kept in mind that a large proportion of the average wind speed scale lies below 12 $km.h^{-1}$.

The windmill 10 operates as follows: the compressor 20, powered by the wind wheel 22 charges the conduit 24 with compressed air which is led to the cylinder 16 via a pressure reducing valve 28. As soon as the compressor 20 delivers more than the air required to operate the pump, the pressure builds up behind the pressure reducing valve 28 the compressed air being stored in the conduit 24 at a pressure higher than the predetermined operating pressure, which is of course, determined by the setting of the pressure reducing valve 28. It can be seen therefore that the conduit 24 in fact acts as a primary air reservoir. However before this pressure builds-up occurs the resistance of a check valve 30 located in the top of the tower 26 is overcome and the tower 26 is charged with compressed air, thereby acting as a second reservoir. Charging of the two reservoirs 24, 26 in fact takes place simultaneously. If the wind drops to a level below which the compressor 20 delivers less air than is required, the air in the conduit 24 is rapidly depleted so that the pressure therein falls below the operating pressure. As this pressure drop occurs a second pressure reducing valve 32 allows the air from the tower 26 into a line 35 below a check valve 34 which prevents the air from moving up into the conduit 24, but instead routes it to the cylinder 16 via line 35. A check valve 36 is located between the pressure reducing valve 32 and the entrance to the line 35 to prevent the movement of air from the conduit 24 to the tower 26 through the pressure reducing valve 32.

As can be seen from FIG. 1, a plurality of reservoirs 37 can be connected to the tower to increase the storage capacity of the windmill 10.

The water from the well is pumped to a watering trough 38 and a pneumatic float switch 40 is provided to control the rate of pumping. The float switch is pneumatically connected to the directional control valve 19 to close the compressed air supply to the piston 14 when the trough 38 is full, thereby temporarily stopping the pump. As soon as the water level drops the float switch actuates the directional control valve to resume pumping whether the wind is blowing or not, the sole requirement being the availability of stored compressed air in the tower 26.

Figure 2:
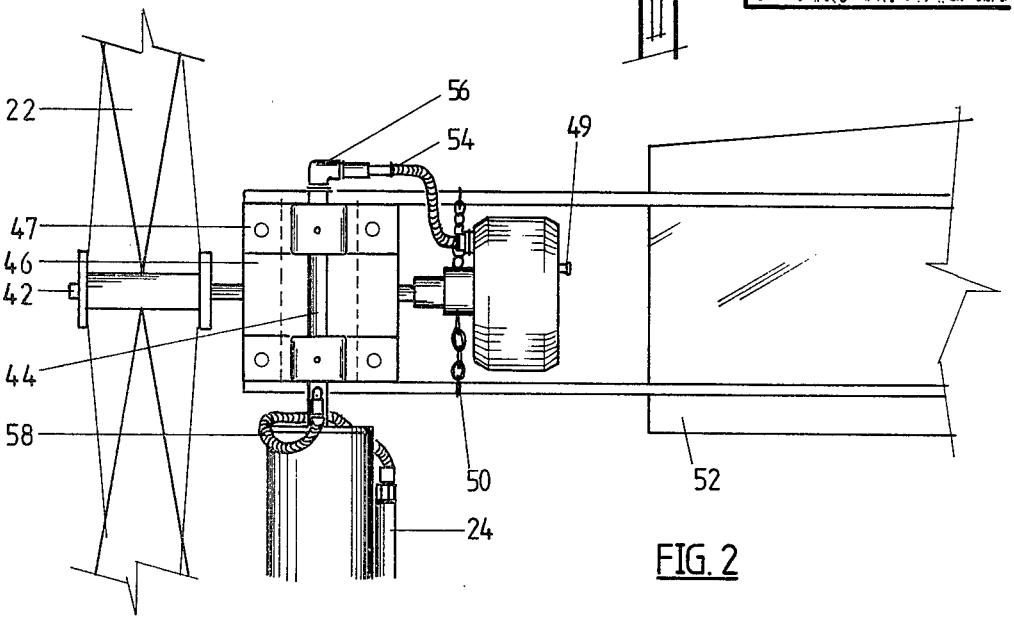
FIG. 2 is a side elevation of a wind wheel and compressor assembly.

The wind wheel-compressor assembly shown in FIGS. 2 and 9, comprises the wind wheel 22 the axle of which is journalled to a plate 44 by means of two bearings 46. The plate 44 itself is journalled to a hollow vertical shaft 48 on the top of the tower 26 by means of two bearings 47. The axle 42 of the wind wheel 22 is connected to the compressor 20 by means of a splined fitting and the compressor 20 is held against rotation relatively to the plate 44 by means of a torque chain 50. A wind vane 52 keeps the wheel 22 at the most efficient angle to the wind. The output line 54 of the compressor is connected to the top of the hollow shaft 48 by means of a rotateable seal 56, discharging compressed air directly down the shaft 48 to the tower 26 across the check valve 30 and to the conduit 24 by means of the line 58 to the conduit 24 which connects into the side of the shaft 48. A relief valve 49 is provided on the compressor 20.

Figure 3:
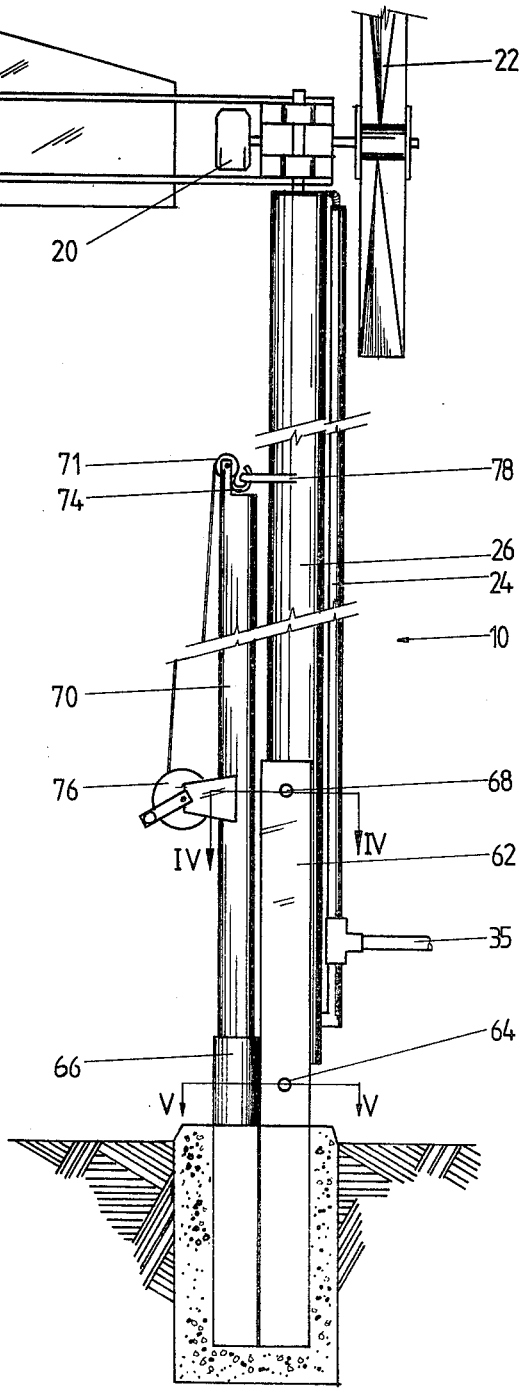
FIG. 3 is a side elevation of the windmill.

In FIG. 3, the tower is mounted on a channel iron base 62 to which the tower 26 is connected with two bolts 64,68, the base 62 being embedded in a concrete foundation. A tubular socket 66 is connected to the base 62 and is embedded in the concrete to facilitate the erection of the tower in a manner to be described. The line 35 to the borehole leads off from the bottom of the conduit 24.

Figure 4:
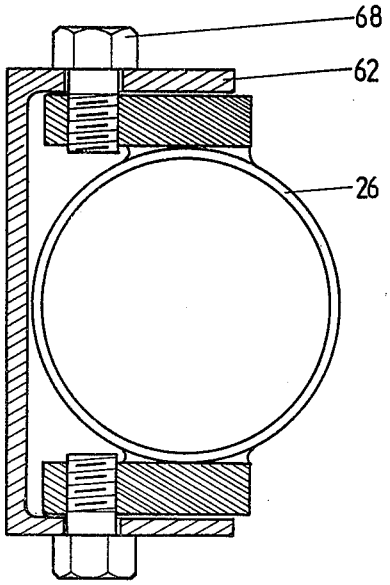
FIG. 4 is a plan section taken on the line IV—IV in FIG. 3.
Figure 6:
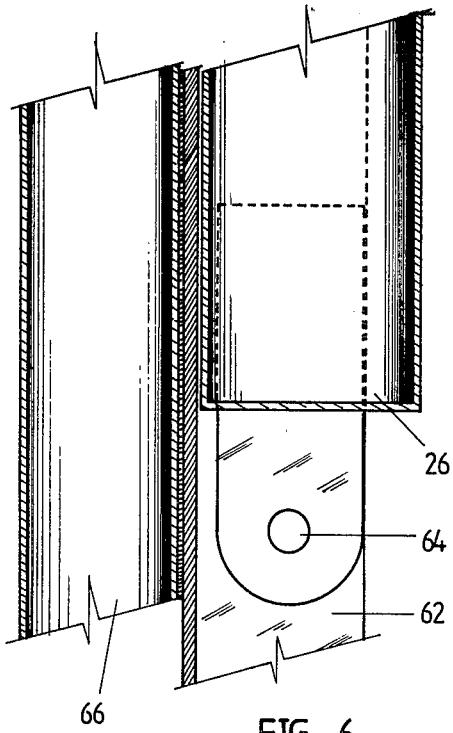
FIG. 6 is a sectional side elevation taken on line VI—VI in FIG. 5.
Figure 5:
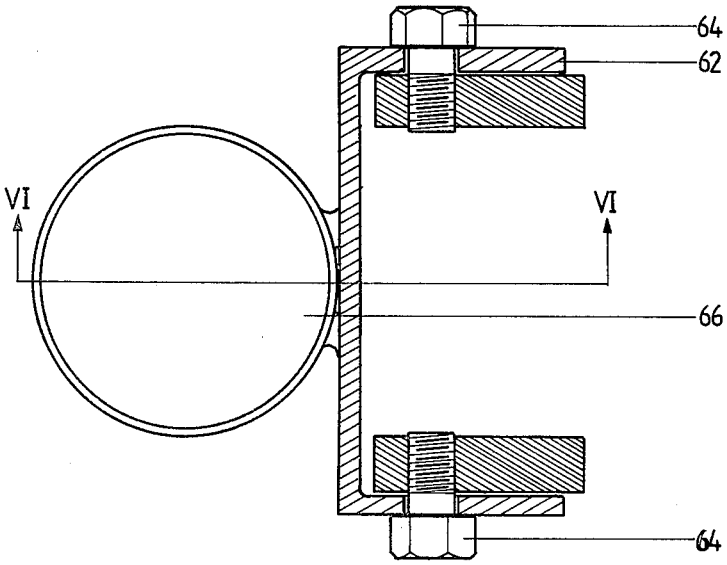
FIG. 5 is a plan section taken on line V—V in FIG. 3.
Figure 7:
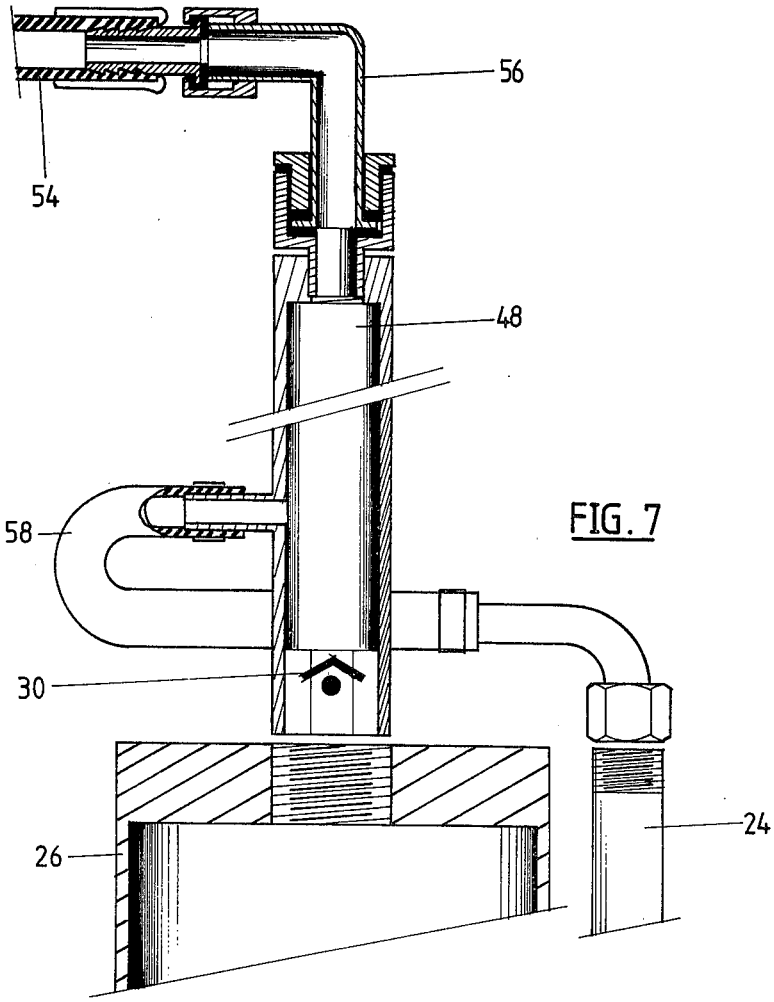
FIG. 7 is a section showing the top of the tower.
Figure 8:
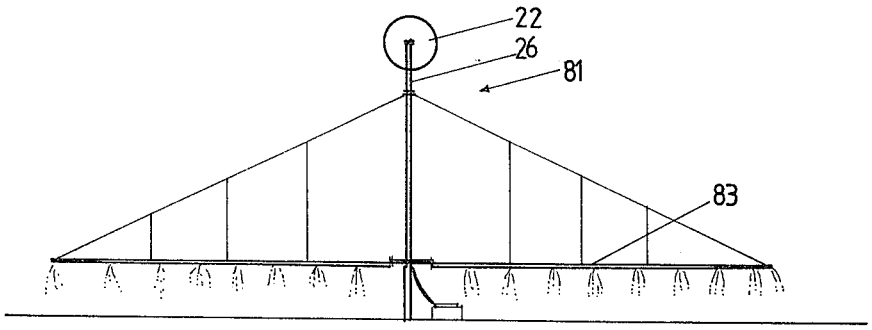
FIG. 8 is a side elevation of a sprinkler system using the windmill of the invention.

To lower the tower 26 a standard 70 is provided which fits into the socket 66 embedded in the concrete. The top of the standard 70 is provided with a grooved pulley 71 over which a rope 72 with a hook 74 on the end thereof, is arranged. The other end of the tope 72 is reeled onto a reel 76 attached to the standard 70 at a convenient height. Once the standard 70 is in position in the socket 66 with the hook engaged with a bracket 78 on the tower 26, the bolt 68, which is shown in more detail in FIG. 4, is undone and the rope 72 is unwound from the reel 76 to lower the tower 26. The raising of the tower is done in exactly the same manner by merely reversing the sequence of operations. Once lowered, the tower 26 can be removed from the base 62 completely by loosening the bolt 64, which is shown in more detail in FIGS. 5 and 6.

The pump head arrangement (shown in FIG. 1) comprises a frame (not shown) on which the cylinder 16 is mounted, the piston rod 17 being dependent from the cylinder 14 and attached directly to the pull rod 15 of a borehole pump, which pumps water along the pipe 80. It will be appreciated that the cylinder 16 may be replaced by a double acting air cylinder and piston.

As the windmill 10 supplies compressed air, the well known air lift method of pumping water can be utilised or, by pressurising air over water, various surface pumping systems may be applied, without the need for elevated header tanks.

In transportation all components are easily packaged into reasonable proportions in size and weight. Installation is very simple and needs no experience. This may be achieved by a farmer and one labourer with the help of an instruction pamphlet. Further reservoirs may be added by simply inter-connecting them with a flexible air pipe. No foundations are needed for these. Extra reservoirs are simple adequately dimensioned butt welded standard pipes. As the wind pump unit is connected to the pumping head by a single flexible air pipe, accurate, foundations are not necessary.

One man can lower or erect the entire wind pump column to lubricate or work on the wind wheel and all air components are easy to replace or repair as this normally entails the mere replacement of a few seals.

Very high wind wheel speeds are utilised as a compressor of very small displacement is used in addition to a direct coupling (one wind wheel revolution to one compressor stroke). The air compressor can work at speeds of up to 600 r.p.m. and a properly balanced wind wheel can also rotate at that speed thereby using almost all the energy of the wind at high velocities and conversely, because of the light load, compressing air at low wind speeds. This also fully exploits gusty wind conditions. Furling and braking systems are not necessary, the reason being that the compressor is capable of handling the highest speed that the wheel is capable of. Smaller diameter wind wheels than used at present are used as the lifting capacity depends on the piston size and not the size of wind wheel.

A further application of the invention is shown in FIG. 9 in which the wind mill supplies a boom arrangement 81 mounted for rotation about the tower 26 and carrying water for overhead irrigation for crops. The sprinkler booms 84 swivel randomly around the windmill 10 in the slightest breeze, irrigating the area covered by the booms 84. In practice it has been found that the water application over the entire area is very even. A simple valve directs the water either to the sprinkler pipe or to a reservoir or drinking troughs.

The advantages accruing from the use of the system which have not yet been mentioned specifically are that water is pumped directly to stock watering troughs on demand, therefore, water storage tanks are not necessary in many cases. Or, one windmill can be linked up by piping to operate two or three pumps simultaneously each extra length of piping additional storage for compressed air.

The windmill can be located at a convenient place, even if the location is remote from the pumps, thereby taking advantage of clear spaces or hilltops where wind conditions are at their best.

I claim:

1. A wind driven compressor and compressed gas storage system comprising a compressor and wind driven energising means therefor, a first, small capacity reservoir, a second large capacity reservoir connected in parallel to the compressor and a compressed gas demand, valves means adapted to allow compressed gas to by-pass the large capacity reservoir when the compressor output is just sufficient to satisfy the compressed gas demand, to allow charging of the large capacity reservoir when the compressor output exceeds the demand and to allow the discharge, to compressed gas demand, of compressed gas stored in the large capacity reservoir when the compressor output is insufficient to satisfy the demand, the valves means comprising a check valve in the large capacity reservoir inlet, a regulator in the large capacity reservoir outlet which is adapted to release the compressed gas stored in the large capacity reservoir to the compressed gas demand when the pressure in the line between the regulator and the compressed gas demand falls below a predetermined minimum and a check valve in the outlet of the small capacity reservoir which is adapted to prevent movement of compressed gas from the outlet of the large capacity reservoir to the small capacity reservoir.

* * * * *